US008556581B2

(12) United States Patent
Davey

(10) Patent No.: US 8,556,581 B2
(45) Date of Patent: Oct. 15, 2013

(54) STATOR VANE ASSEMBLY

(75) Inventor: Richard P. A. Davey, Bristol (GB)

(73) Assignee: Rolls-Royce PLC, London (GB)

( * ) Notice: Subject to any disclaimer, the term of this patent is extended or adjusted under 35 U.S.C. 154(b) by 1100 days.

(21) Appl. No.: 12/461,421

(22) Filed: Aug. 11, 2009

(65) Prior Publication Data

US 2010/0086401 A1 Apr. 8, 2010

(30) Foreign Application Priority Data

Oct. 6, 2008 (GB) ..... 0818136.4

(51) Int. Cl.
*F04D 29/54* (2006.01)

(52) U.S. Cl.
USPC ..... 415/209.4; 416/DIG. 3; 415/210.1

(58) Field of Classification Search
USPC ..... 416/DIG. 3; 415/142, 208.1, 208.2, 415/209.4, 210.1
See application file for complete search history.

(56) References Cited

U.S. PATENT DOCUMENTS

| | | | | |
|---|---|---|---|---|
| 2,859,934 A | | 11/1958 | Halford et al. | |
| 3,719,431 A | * | 3/1973 | Steele et al. | 416/96 R |
| 4,163,629 A | * | 8/1979 | McDonough et al. | 415/115 |
| 4,384,822 A | | 5/1983 | Schweikl et al. | |
| 4,920,742 A | * | 5/1990 | Nash et al. | 60/799 |
| 5,584,652 A | | 12/1996 | Shaffer et al. | |
| 5,609,467 A | * | 3/1997 | Lenhart et al. | 415/142 |

FOREIGN PATENT DOCUMENTS

WO WO 82/01033 A1 4/1982

* cited by examiner

*Primary Examiner* — Nathaniel Wiehe
*Assistant Examiner* — Adam W Brown
(74) *Attorney, Agent, or Firm* — Oliff & Berridge, PLC

(57) ABSTRACT

A stator vane assembly comprising inner and outer support rings connected by an annular array of stator vanes at locations around the supporting rings, at least one of said stator vanes in said array being a separate, pre-formed stator vane which is slidably connected to one or both of the supporting rings for radial movement relative to the respective support ring thereby to accommodate relative radial expansion of the support rings.

15 Claims, 4 Drawing Sheets

STATOR VANE ASSEMBLY

BACKGROUND

The present invention relates to a stator vane assembly for turbomachinery, in particular a stator vane assembly for a gas turbine such as, for example, a nozzle guide vane assembly.

Stator vanes are generally used in turbomachinery to modify the flow characteristics of the working fluid. This may be desirable for efficient transfer of kinetic energy from the working fluid to a respective rotative element or "rotative", such as a turbine, in which case the vanes are designed to swirl the working fluid in the direction of nominal rotation of the rotative. Alternatively, it may be desired to remove "swirl" from a working fluid, for example downstream of a respective compressor rotor in a gas turbine compressor stage, and stator vanes are also typically used for this purpose.

SUMMARY

Generally speaking, the stator vanes will be arranged in an annular array between respective inner and outer supports, which typically take the form of support rings, with each individual vane extending substantially radially between the supports. The stator vane assembly as a whole thus defines an annular aerodynamic "throat" for the working fluid.

An example of such a stator vane assembly is a nozzle guide vane (NGV) assembly in a gas turbine engine, which is positioned upstream of a respective turbine rotor for increasing the tangential momentum of gas leaving the combustor in order to maximise energy transfer from the working fluid to the turbine rotor.

Typically, stator vane assemblies are formed by casting. However, due to the complex shape of the stator vane assemblies, the casting process tends to be difficult and expensive. In addition, the resulting castings tend to exhibit high thermal stresses within their structure, particularly in the case of NGV assemblies, which can be subject to extremely high operating temperatures and associated thermal gradients.

It is an object of the present invention to seek to provide an improved stator vane assembly and a method for assembling such a stator vane assembly.

According to the present invention there is provided a stator vane assembly comprising inner and outer support rings connected by an annular array of stator vanes at locations around the supporting rings, at least one of said stator vanes in said array being a separate, pre-formed stator vane which is slidably connected to one or both of the supporting rings for radial movement relative to the respective support ring thereby to accommodate relative radial expansion of the support rings, wherein at least one of the support rings comprises a fixed locating element, and the stator vane (4) is a bent sheet metal blank which is detachably clipped around the outside of the or each respective locating element, the vane being configured for radial telescopic movement relative to the fixed locating element.

At least one of said stator vanes may be detachably connected to the respective support rings.

The at least one vane or vanes may telescopically engage a respective fixed locating element on one of the support rings for radial telescopic movement relative to that support ring. The relevant vane may additionally telescopically engage a corresponding respective fixed locating element on the other of said support rings for radial telescopic movement relative to that support ring; alternatively, the vane may be fixed to the other of said support rings, for example in fixed, telescopic engagement with a respective locating element on that other support ring. The fixed telescopic engagement may be by means of an interference-fit.

In one embodiment, the vane comprises a hollow-section aerofoil body which telescopically receives the respective locating element or elements.

The aerofoil body may be formed from sheet metal. More specifically, the aerofoil body may be a bent sheet metal blank which is detachably clipped around the outside of each respective locating element thereby to secure the vane in telescopic engagement with that locating element. Alternatively the aerofoil body may be made from a ceramic or composite material.

The cross-sections of the aerofoil body and respective locating elements may be such that, with the aerofoil body clipped around the outside of the locating elements, trailing edges of the aerofoil body are splayed outwardly thereby to induce a compressive stress along the leading edge of the aerofoil body.

The trailing edge of the aerofoil may comprise a plug for limiting exit of fluid inside the aerofoil, along the trailing edge.

One or more of the locating elements may comprise a port for delivering coolant to the interior of the respective aerofoil body. One or more of the locating elements may also comprise a port for ejecting coolant from the interior of the respective aerofoil body. Each locating element in a respective pair of locating elements may comprise a corresponding port and the ports may then be fluidly connected to one another by a perforated tube extending radially between the support rings, inside the aerofoil body. For example, one locating element of a pair may comprise a port for delivering coolant to the interior of the respective aerofoil body, with the other locating element comprising a port for ejecting coolant from the interior of the respective aerofoil body. Alternatively, both locating elements of a pair may comprise a port for delivering coolant to the interior of the respective aerofoil body.

According to another aspect of the present invention, there is provided a method of assembling a stator vane assembly according to the present invention, the method including the steps of circumferentially aligning the support rings relative to one another and subsequently clipping each aerofoil body around the respective locating element, or circumferentially aligned pair of respective locating elements, thereby to connect the respective vane between the support rings. The method may additionally comprise attaching a respective plug along the trailing edge of one or more of the aerofoil bodies.

BRIEF DESCRIPTION OF THE DRAWINGS

Embodiments of the invention will now be described in more detail, by way of example, with reference to the accompanying drawings, in which.

DETAILED DESCRIPTION OF THE EMBODIMENTS

Figure 1:
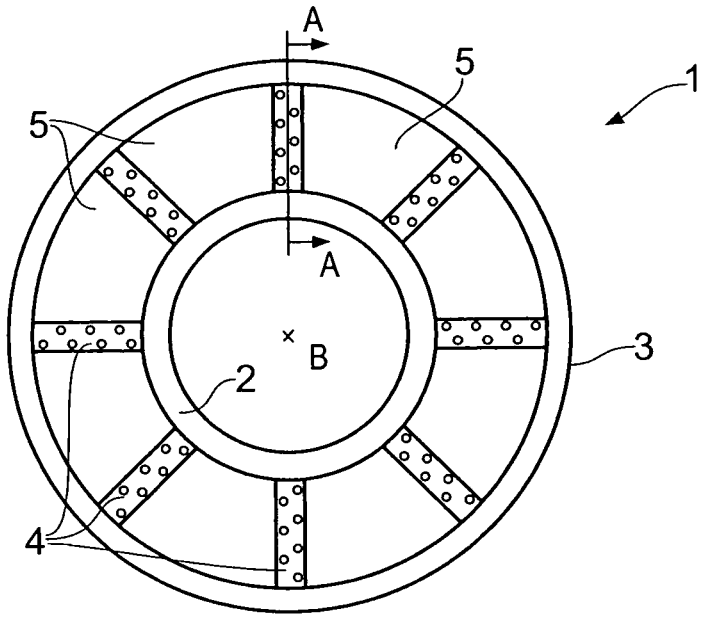
FIG. 1 is a highly schematic frontal view of a stator vane assembly.
Figure 2:
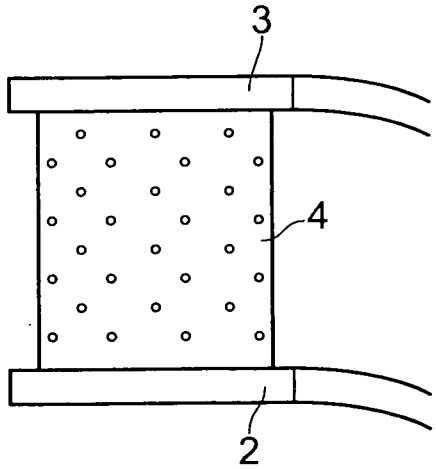
FIG. 2 is a three-quarter cross-sectional view along A-A in FIG. 1.

Referring first of all to FIGS. 1 and 2, a stator vane assembly 1 comprises an inner and an outer support in the form of inner and outer support rings 2, 3. The support rings 2, 3 are connected by an annular array of stator vanes 4, which extend radially between the support rings 2, 3, at locations around the circumference of the support rings 2, 3, and which define a corresponding set of windows 5 for receiving an axial flow of working fluid.

The stator vanes 4 each have an axial aerodynamic profile, with the windows 5 thus forming an aerodynamic "throat" for the working fluid, which may for example impart or remove a swirl component in the axial flow of working fluid, depending upon the specific aerodynamic profile of the stator vanes 4.

Figure 3:
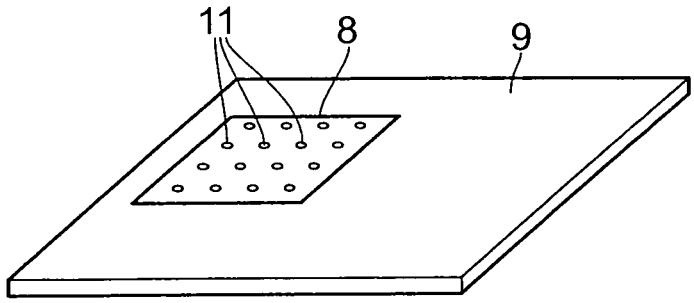
FIG. 3 is a schematic view illustrating a step in forming an aerofoil body.
Figure 4:
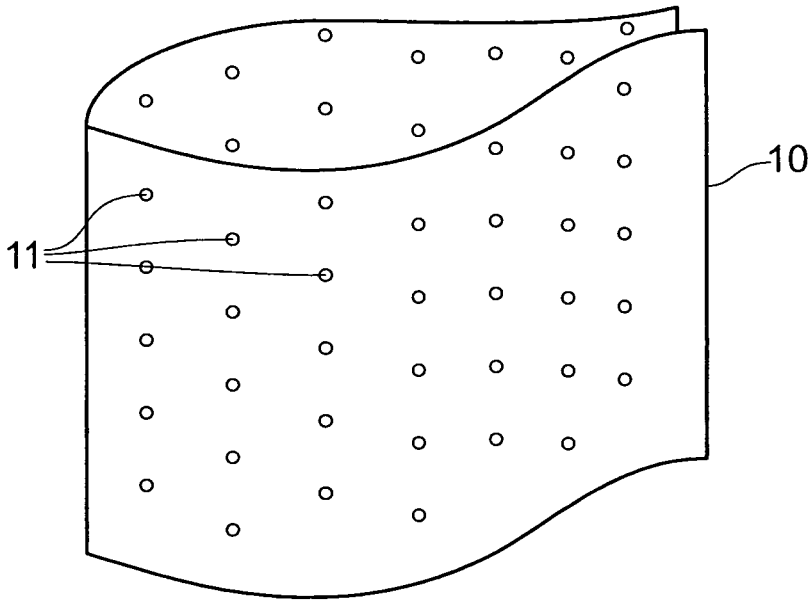
FIG. 4 is a schematic perspective view of an aerofoil body.

The stator vanes 4 are not integrally formed with the support rings 2, 3 (for example by casting). Instead, each of the stator vanes 4 is preformed from sheet metal by cutting a suitable blank 8 from a flat metal sheet 9 (see FIG. 3) and subsequently bending the blank 8 into a suitable aerofoil body 10, shown in FIG. 4.

Prior to forming the hollow-section aerofoil body 10, a pattern of cooling holes 11 is drilled into the sheet metal blank 8 (see FIG. 3), for example using laser drilling, so that the resulting aerofoil body 10 is perforated. The particular pattern of cooling holes will generally be predetermined according to the expected cooling requirements for the aerofoil body 10, and the pattern may be irregular across the surface of the aerofoil body 10 in order to account for local variations in cooling requirements.

The cooling holes 11 may be cut into the metal sheet 9 prior to cutting of the blank 8.

Optionally, the blank 8 or sheet 9 may also be subjected to other forms of surface processing in order to provide other surface features prior to forming the aerofoil body 10. Such features might include structural ribbing or a specific surface profile or "relief" intended to enhance thermal cooling. One or more surface coatings may also conveniently be applied to the blank 8 or sheet 9 as appropriate, prior to formation of the aerofoil body 10.

A number of suitable blanks 8 may be cut from a single sheet 9, for example following suitable surface processing of the corresponding areas of the sheet 9.

Each pre-formed aerofoil body 10 is detachably secured to the support rings 2, 3 by engagement with a respective pair of locating elements on the support rings 2, 3.

Figure 5:
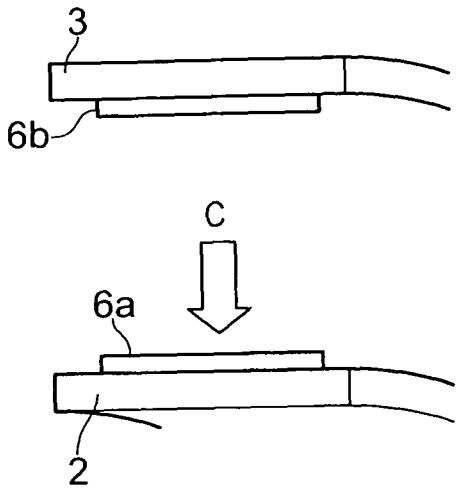
FIG. 5 is a view corresponding to FIG. 2, but with the respective stator vane removed.

The locating elements are not visible in FIGS. 1 and 2, being obscured by the respective stator vanes 4, but an individual pair of these locating elements is visible in FIG. 5, which shows one of the stator vane locations around the support rings 2,3 with the respective stator vane 4 having been removed.

The locating elements are in the form of bosses 6*a*, 6*b* which are fixed to the respective supporting rings 2, 3.

The bosses 6*a*, 6*b* may be fixedly attached to the respective support rings 2, 3 using any suitable means, for example bolts, screws or adhesive bonding. Alternatively, the locating elements may be formed integrally with the respective support rings 2,3.

Figure 6:
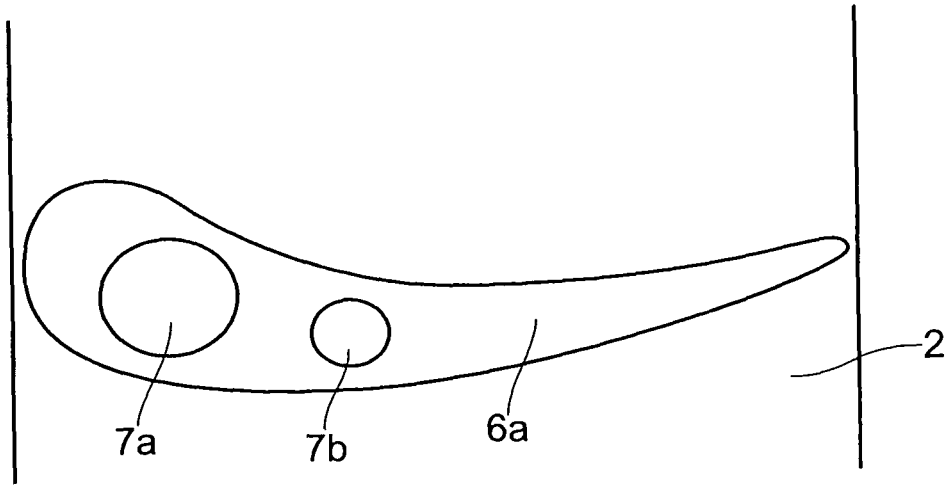
FIG. 6 is a plan view looking along the direction C in FIG. 5.

Each of the locating bosses 6*a*, 6*b* has a cross-sectional shape corresponding substantially to the hollow cross-section of the aerofoil body 10. The cross-sectional shape for locating boss 6*a* specifically is shown in FIG. 6.

The respective aerofoil body 10 is engaged in a telescopic sliding fit with the locating bosses 6*a*, 6*b* by resiliently clipping the (sheet metal) aerofoil body 10 onto the locating bosses 6*a*, 6*b* ie the (resilient) trailing edges of the aerofoil body 10 are initially forced around the outside of the leading edge of each locating boss 6*a*, 6*b* (to the right in FIG. 6) until the trailing edges of the aerofoil body "clear" the enlarged leading portion of the respective locating elements 6*a*, 6*b*, whereupon the trailing edges of the aerofoil body spring back towards each other to "spring-clip" the aerofoil body 10 securely around the outside of locating elements 6*a*, 6*b*.

The cross-section of the aerofoil body 10 and each locating boss 6*a*, 6*b* may be designed so that, with the aerofoil body 10 clipped in place, the aerofoil body 10 exerts a compressive resilient "grip" load on the outside of the bosses 6*a*, 6*b*, tending to resist unintentional detachment (or "unclipping") of the aerofoil body 10 from the locating elements 6*a*, 6*b* (and hence the support rings 2, 3). In a similar manner, the cross-section of the aerofoil body 10 and each locating boss 6*a*, 6*b* may be designed so that, with the aerofoil body 10 clipped in place, the trailing edges of the aerofoil body 10 are resiliently splayed outwards (by the locating elements 6*a*, 6*b*), inducing a corresponding compressive stress along the leading edge of the aerofoil body 10 which may improve resistance to fatigue along the leading edge.

Alternatively, or additionally, the aerofoil body 10 may be provided with a plug along the trailing edge (which may incorporate one or more cooling holes or slots) or the aerofoil body 10 may be riveted, seam-welded or spot-welded along the trailing edge, in each case reducing the possibility that the trailing edges of the aerofoil body 10 being inadvertently driven apart by the pressure of the working fluid, tending to "unclip" the aerofoil body 10 from the locating elements 6*a*, 6*b*.

The locating elements 6*a*, 6*b* thus circumferentially locate the aerofoil body 10 and prevent twisting movement of the aerofoil body 10. At the same time, the locating elements 6*a*, 6*b* nevertheless support radial sliding movement of the aerofoil body relative to each of the support rings 2, 3 for accommodating relative radial expansion of the support rings 2, 3 thereby to alleviate any consequent thermal induced stress in the structure of the stator vane assembly 1.

Each locating element may be provided with one or more corresponding cooling ports communicating with the inside of the respective hollow-section aerofoil body 10 for receiving coolant to the interior of the aerofoil body 10, or discharging coolant from the interior of the aerofoil body 10, as required. FIG. 6 shows two such cooling ports 7*a*, 7*b* for the locating element 6*a*.

Figure 7:
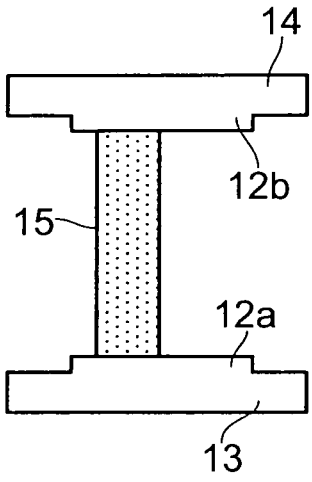
FIG. 7 is a cross-sectional view through part of a stator vane assembly according to a further embodiment of the present invention.

In a specific embodiment shown in FIG. 7, a respective pair of locating elements 12*a*, 12*b* (in this case integrally formed with respective support rings 13, 14) comprise corresponding aligned cooling ports (not labelled) which are connected to one another by a perforated tube 15 extending between the respective support rings 13, 14 inside the aerofoil body of the respective stator vane (not shown in FIG. 7). In such an arrangement, it is envisaged that coolant may be passed through the perforated tube 15 via the respective cooling ports, for diffusion into the interior space of the respective aerofoil body.

Although in the embodiment described the aerofoil body 10 engages both locating elements 6*a*, 6*b* in a sliding telescopic fit, it is envisaged that in general a given stator vane may be fixed to one of the locating elements, provided that it nevertheless slidably engages the other respective locating element. For example, the aerofoil body 10 may be fixedly bonded to one of the locating elements 6*a*, 6*b* or engage one of the locating elements 6*a*, 6*b* in a telescopic interference fit (whilst nevertheless engaging the other locating element 6*b*, 6*a* in a telescopic sliding fit).

It is envisaged that utilising stator vanes which are pre-formed separately from the support rings would allow for greater flexibility in manufacturing the support rings. For example, it is envisaged that the respective support rings may be forged rather than cast, or may be formed from composite materials, potentially allowing for use of higher strength materials and increasing design flexibility in the support ring profile for improving support ring sealing performance.

In addition, in the case where the stator vanes detachably engage the support rings, as in the case of the aerofoil body 10, it is envisaged that following initial assembly of the stator vane assembly, the respective individual stator vanes could then be separately removed and replaced as individually required. In the case of aerofoil body 10, it is envisaged that detachment by "unclipping" the aerofoil body 10 from the respective locating elements 6*a*, 6*b* would be particularly convenient.

The invention claimed is:

1. A stator vane assembly comprising inner and outer support rings connected by an annular array of stator vanes at locations around the support rings, at least one of said stator vanes in said array being a separate, pre-formed stator vane which is slidably connected to one or both of the support rings for radial movement relative to the respective support ring thereby to accommodate relative radial expansion of the support rings, wherein at least one of the support rings comprises a fixed locating element, and the stator vane is a bent sheet metal blank which is detachably clipped around the outside of the or each respective locating element, the vane being configured for radial telescopic movement relative to the fixed locating element.

2. A stator vane assembly according to claim 1, wherein the vane telescopically engages fixed locating elements on both of said support rings for radial telescopic movement relative to both support rings.

3. A stator vane assembly according to claim 1, wherein the vane is fixed to one of said support rings.

4. A stator vane assembly according to claim 3, wherein the vane is in fixed, telescopic engagement with a respective locating element on said support ring.

5. A stator vane assembly according to claim 4, wherein said fixed telescopic engagement is by means of an interference-fit.

6. A stator vane assembly according to claim 1, wherein the vane comprises a hollow-section aerofoil body which telescopically receives the respective locating element or elements.

7. A stator vane assembly according to claim 6, wherein the aerofoil body is formed from sheet metal.

8. A stator vane assembly according to claim 6, wherein one or more of the locating elements comprise a port for delivering coolant to the interior of the respective aerofoil body.

9. A stator vane assembly according to claim 8 wherein each locating element in a respective pair of locating elements comprises a corresponding port and the ports are fluidly connected to one another by a perforated tube extending radially between the support rings, inside the aerofoil body.

10. A stator vane assembly according to claim 6, wherein one or more of the locating elements comprise a port for ejecting coolant from the interior of the respective aerofoil body.

11. A stator vane assembly according to claim 1, comprising a plurality of said vanes slidably connected to one or both support rings for said relative radial movement, each of said vanes being in accordance with claim 1.

12. A stator vane assembly according to claim 1, wherein the stator vane assembly is a nozzle guide vane assembly.

13. A method of assembling a stator vane assembly according to claim 6, the method including the steps of circumferentially aligning the support rings relative to one another and subsequently clipping each aerofoil body around the respective locating element, or circumferentially aligned pair of respective locating elements , thereby to connect the respective vane between the support rings.

14. A method according to claim 13, further comprising attaching a respective plug along the trailing edge of one or more of the aerofoil bodies.

15. The stator vane assembly according to claim 1, wherein the stator vane is directly connected to one or both of the support rings.

* * * * *